US012752982B2

(12) United States Patent
Hernandez Rodriguez et al.

(10) Patent No.: US 12,752,982 B2
(45) Date of Patent: Oct. 6, 2026

(54) CONTAINER LID

(71) Applicant: FEI Corporation, Hillsboro, OR (US)

(72) Inventors: Nestor Hernandez Rodriguez, Eindhoven (NL); Mathijs Petrus Wilhelmus van den Boogaard, Oirschot (NL); Martijn Roger La Grange, Oisterwijk (NL); Ross David Savage, Eindhoven (NL)

(73) Assignee: FEI Company, Hillsboro, OR (US)

( * ) Notice: Subject to any disclaimer, the term of this patent is extended or adjusted under 35 U.S.C. 154(b) by 393 days.

(21) Appl. No.: 18/195,711

(22) Filed: May 10, 2023

(65) Prior Publication Data

US 2023/0365307 A1 Nov. 16, 2023

Related U.S. Application Data

(60) Provisional application No. 63/342,024, filed on May 13, 2022.

(51) Int. Cl.
*B65D 47/26* (2006.01)
*B65D 25/04* (2006.01)

(52) U.S. Cl.
CPC ..... *B65D 47/265* (2013.01); *B65D 25/04* (2013.01); *B65D 2547/06* (2013.01)

(58) Field of Classification Search
CPC ..... B65D 43/00; B65D 43/14; B65D 43/22; B65D 43/20; B65D 47/265; B65D 51/26; B01L 3/50853; B01L 3/50825; B01L 9/52; B01L 9/00; B01L 2300/045; B01L 2300/041; B01L 2300/04
See application file for complete search history.

(56) References Cited

U.S. PATENT DOCUMENTS 5,314,068 A * 5/1994 Nakazato ..... G03F 7/7075 206/454
5,366,079 A * 11/1994 Lin ..... H10P 72/1912 206/821
11,217,467 B2 * 1/2022 Daginnus-Metzen ..... H10P 72/1912
2005/0002763 A1 * 1/2005 Kampf ..... H10P 72/1904 414/403

FOREIGN PATENT DOCUMENTS

JP 2000315722 A * 11/2000

OTHER PUBLICATIONS

EP23173312.2, Extended European Search Report, Oct. 12, 2023, 10 pages.

* cited by examiner

*Primary Examiner* — Javier A Pagan

(57) ABSTRACT

Apparatus and methods are disclosed for container lids, suitable for use in reliable automated handling and transport of lamella carriers used for transmission electron microscopy samples, or similar light or thin objects. A lid is for use with a container having one or more cavities that can be accessible through a top surface of a container. The lid can comprise a rigid member having a planar surface. Affixed to the rigid member are a first means for constraining motion of the planar surface to one-degree of freedom movement over the top surface, and a second means for restricting motion, within the cavity, of a lamella carrier contained within the cavity.

20 Claims, 6 Drawing Sheets

CONTAINER LID

CROSS REFERENCE TO RELATED APPLICATIONS

This application claims the benefit of U.S. Provisional Application No. 63/342,024, filed on May 13, 2022, which is incorporated herein by reference in its entirety.

BACKGROUND

Transportation of lamella carriers calls for containers and procedures that securely retain the lamella carriers without damage or loss. Conventional containers consist of compartments that do not adequately constrain the movement of the lamella carriers within their compartments. For example, the lamella carriers can stick to the lid of the container, getting stuck between the container and the lid. These and other problems render the conventional containers not well suited for automation. Putting on and removing the lids of the conventional containers manually can also cause the lamella carriers to fall out of or eject from the containers. Accordingly, there is a need for improved container lids to provide reliable and automatable transport and handling of thin or light objects such as lamella carriers.

SUMMARY

In brief, the disclosed technologies provide container lids for safe and secure depositing, transporting, and extracting of lamella carriers to and from containers. The disclosed technologies also enable an automated workflow for handling lamella carriers using containers with the disclosed lids.

In a first aspect, the disclosed technologies can be implemented as a lid for covering at least one cavity which can be accessible through a top surface of a container. The lid can include a rigid member having a planar surface. Affixed to the rigid member are a first means and a second means. The first means constrains motion of the planar surface to sliding over the top surface. The second means restricts motion of a lamella carrier contained within the cavity.

In a second aspect, the disclosed technologies can be implemented as a lid for a container. The lid can include a rigid member slidably retained over a surface of the container. One or more guides can be affixed to the rigid member and engaged with the container. The one or more guides can restrict relative motion of the lid and the container to one sliding direction. One or more protrusions can be affixed to the rigid member. The one or more protrusions can extend into respective cavities within the container.

In another aspect, the disclosed technologies can be implemented as a method of operating a container lid. Prior to transport of a container, a lid can be slid to cover one or more cavities accessible from a top surface of the container. The lid can be constrained to slide in one direction over the top surface of the container. Subsequent to the transport, the lid can be retracted to expose the one or more cavities. The lid can include a protrusion from the lid into a given cavity of the one or more cavities. The protrusions can, for example, prevent, during the transport, an object stored within the given cavity from (i) sticking to the lid, (ii) entering a gap between the top surface and the lid, or (iii) flipping over from its initial or intended position. The protrusions can also keep the object resting on the bottom, or landing, surface of the given cavity, rendering it suitable for automation, e.g., to facilitate the extraction of the object. In some examples, the object can be a lamella carrier.

The foregoing and other objects, features, and advantages of the disclosed technologies will become more apparent from the following detailed description, which proceeds with reference to the accompanying figures.

DETAILED DESCRIPTION

Introduction

Figure 2A:
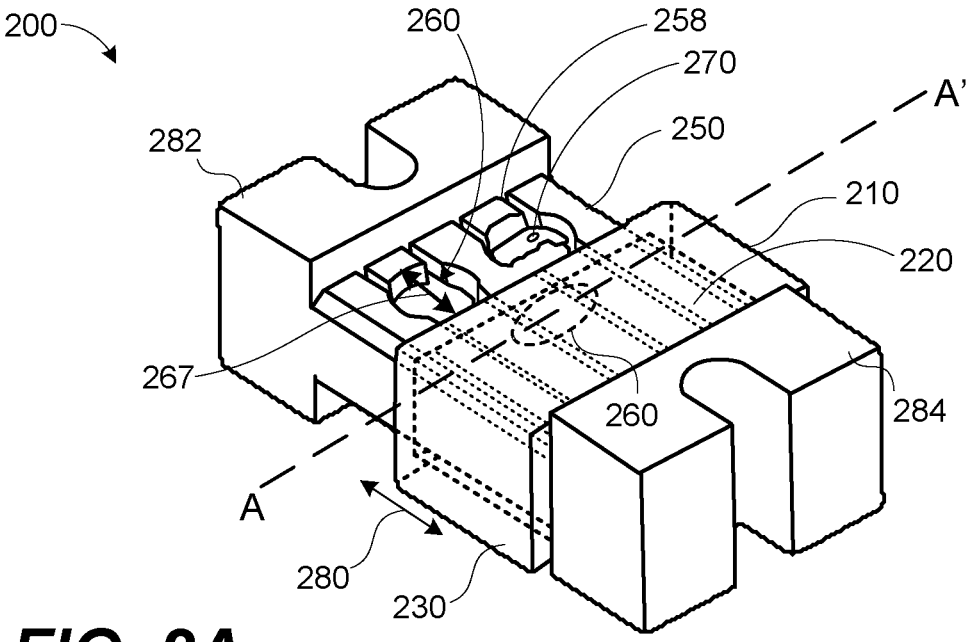
FIG. 2A illustrates a second example lid and container according to the disclosed technologies.
Figure 2B:
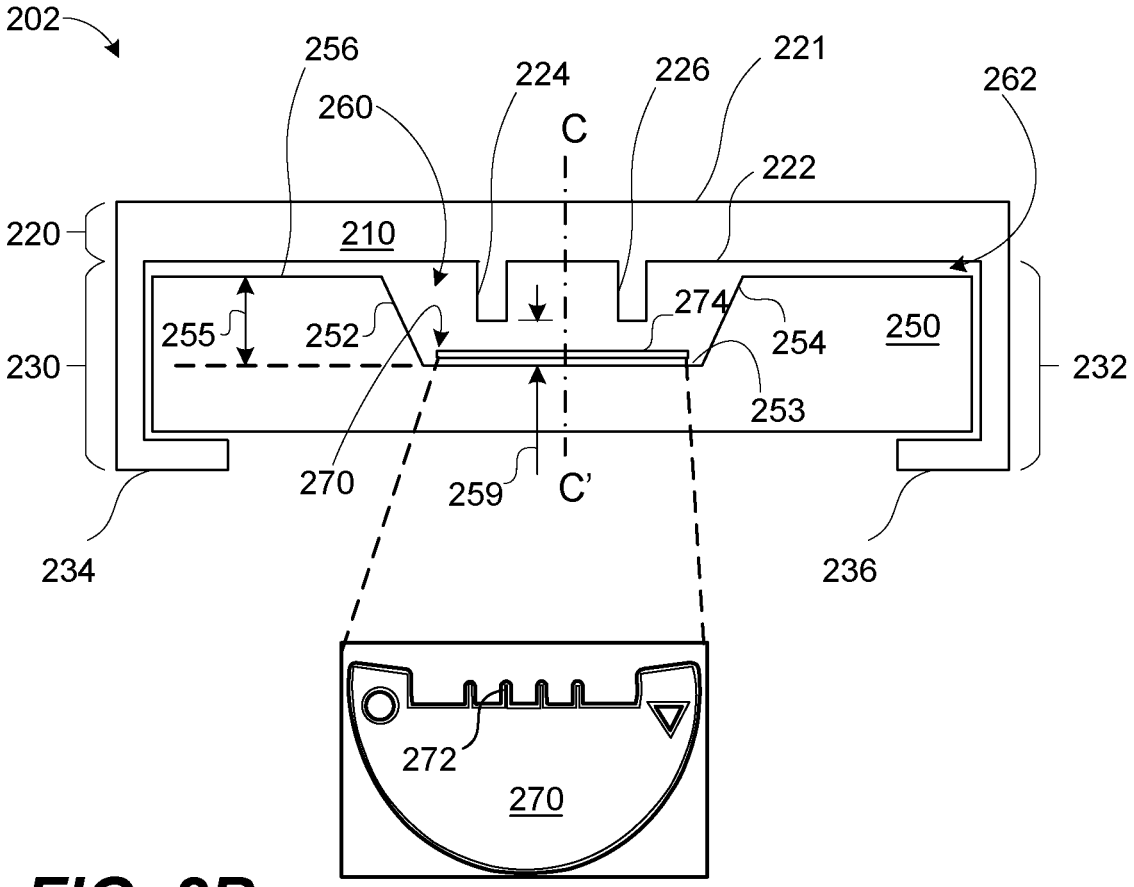
FIG. 2B illustrates a sectional view of the second example lid and container.

Some lamellae used as samples in a transmission electron microscope (TEM) can be about 10-100 nm thick with a transverse extent of 1-100 Lamella carriers can be used to facilitate their handling. The lamella carriers are typically flat and can also be thin (often about 10 μm thick) and light (often weighing less than a milligram each). An example of a typical lamella carrier 270 is shown in FIGS. 2A-2B. Illustrated carrier 270 can have a semi-circular shape with about 3 mm diameter. A lamella (not shown) can be bonded (e.g., welded by a focused ion beam (FIB), or adhered by van der Waals forces) to a wall of finger 272. Other shapes and arrangements of lamella carriers can also be used. Each lamella carrier can support 1 to 1,000 lamellae in various applications.

In turn, lamella carriers can be stored or transported in respective pockets of a container. Each pocket can have straight vertical wall(s) and loosely contains one lamella carrier. A lid can then be put on the container. A typical conventional lid can be a snap-on lid. Due to shaking and other forces encountered during transport, a lamella carrier can move freely within a pocket of the container and can adhere to the inside surface of the lid, for example through electrostatic or van der Waals forces. When the lid is opened to retrieve the lamella carriers, the lamella carriers can often fall off the lid, while some can also be shaken off the container and can be lost or damaged.

Additionally, removal of the lamella carriers that have not fallen off the container can also be fraught with problems. Conventionally, the lamella carriers are often manually removed from the container. For example, the lamella carriers can be removed using tweezers, or any other mechanical tools. These manual methods can damage the lamella carriers, including scratching or bending them. The lamella carriers can also be prone to hitting the vertical wall(s) of the container pockets and can even separate from the lifting tool.

Technologies disclosed herein provide improvements to solve the above problems. For example, a disclosed container lid can prevent lamella carriers from sticking to the inside surface of the lid or getting caught in a gap (such as 262 of FIG. 2B) between the lid and a top surface of the container. The lid movement can be constrained to only one degree of freedom. This constraint can provide smooth and reliable closing and opening which use less force than, for example, opening a snap-on lid in a direction outwardly normal, or away, from the top surface of the container. The pockets containing the lamella carriers can also have slanted walls to provide a clear path for removal of lamella carriers, with less risk of the lamella carriers from hitting the walls.

Further details described below provide brief descriptions of representative container lids which can provide benefits from the disclosed technologies. For purpose of illustration, the examples below depict containers and lids for handling lamella carriers. However, the disclosed technologies can be applied similarly for handling a wide range of other thin or light objects, such as samples of foils, organic or inorganic membranes, or particulate samples from air quality monitoring.

Terminology

The usage and meaning of all quoted terms in this section applies throughout this disclosure unless clearly indicated otherwise or repugnant to the context. The terminology below extends to related word forms.

The expression "A affixed to B" can refer to two distinct pieces A and B attached together, for example, with fastener, glue, welding. The term can also refer to A and B formed integrally as a single unit, for example, molded, machined, extruded, etc., together.

The term "end effector" refers to a device having a manipulation tool at its end. An end effector can be mounted to a robotic arm. End effectors described herein can include tools for inserting a lamella carrier into a container or extracting a lamella carrier from a container. In examples, an end effector can be a vacuum pipette, but this is not a requirement. Adhesive, magnetic, or spring-loaded manipulation tools can also be used.

The term "extensive contact" refers to two objects that lay flat against one another. The presence of surface roughness limiting microscopic to a few discrete points does not preclude extensive contact between the objects. In disclosed examples, a lamella carrier can rest on a bottom surface of a cavity, making extensive contact therewith. In some conventional techniques, a lamella carrier can sometimes make extensive contact with an inner surface of a lid.

The term "lamella" refers to a thin sample suitable for imaging in a transmission electron microscope (TEM). A lamella can have thickness in a range of 5-200 nm, or 10-30 nm, and a transverse extent commonly 1-20 μm.

The term "lamella carrier" refers to a support structure for one or more lamellae. A lamella carrier can have a thickness 1-100 μm, and a transverse extent commonly 0.1-10 mm. A lamella carrier can be compatible with TEM sample handling.

The term "major surface" of a component refers a surface of the component whose area is not substantially exceeded by any other surface of the component.

The term "plate" refers to a solid object having two substantially parallel planar major surfaces, separated by a distance termed "thickness". The thickness and thickness variation of a plate can be less than 25% of any transverse extent of the plate. The presence of holes, attached protrusions or other fittings, bevels, or rounded edges does not preclude an object from being a plate. Some rigid members described herein can be in the form of plates, however this is not a requirement.

The term "any number" refers to a positive integer number N, wherein N can be 1, 2, in a range 3 to 10 inclusive, in a range 11 to 100 inclusive, in a range 101 to 10,000 inclusive, or in a range 10,001 to 10,000,000 inclusive. To illustrate, a disclosed lid can cover a container having a single cavity, while another disclosed lid can cover a container having an array of cavities on an 0.5 mm pitch, so that a 0.5 m×0.5 m container can have up to 1,000,000 cavities, and the corresponding lid can have one or more studs protruding into each cavity when the lid is in a closed position.

The expression "sliding A over B" can include holding B fixed and moving A, or vice versa, or some combination thereof. A direction of sliding can be along a straight line, along an arc of a circle, or along another path. That is, under sliding motion in one direction, a given point on an object being slid can traverse a straight line, a circular arc, or a line of another shape.

The terms "top," "bottom," "up," "down," "horizontal," "vertical," and the like are used for convenience, with respect to a common configuration in which a lid is positioned on a top surface of a container. One of ordinary skill will understand from this disclosure that a choice of actual orientation can be varied without departing from the scope of the disclosed technologies. The term "outwardly normal" refers to a direction away from a major surface of an object, such as upward from a top surface of a container or a top surface of a lid. The term "transverse" refers to a direction within or parallel to a major surface of an object.

First Example of Container Lid

Figure 1:
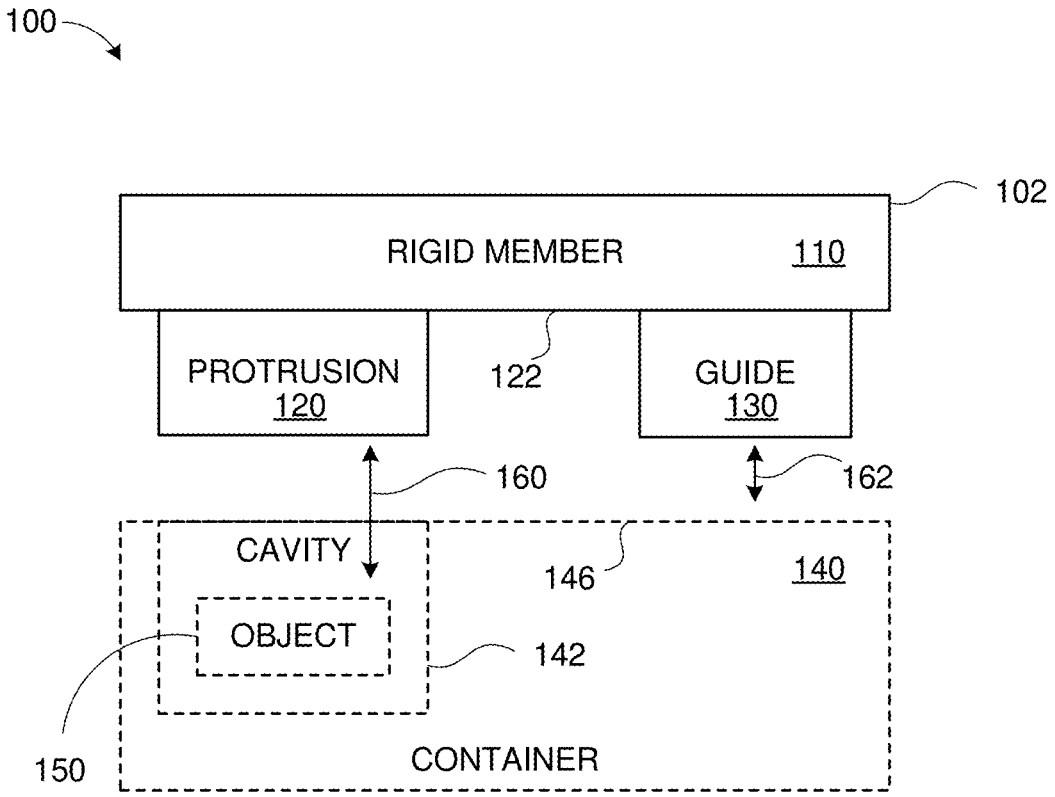
FIG. 1 illustrates a first example lid and container according to the disclosed technologies.

FIG. 1 is a diagram 100 illustrating an example of a lid 102 which can be used with a container 140. The container 140 includes a cavity 142 sized to receive an object 150. Although only one cavity 142 is shown, the container 140 can have any number of cavities. The lid 102 includes a rigid member 110. The rigid member 110 can have an exterior surface and an interior surface 122 which is opposite the exterior surface. The interior surface's 122 face is proximate and conforming to a top planar surface of the container 140 when the lid 102 is attached to the container 140. The object 150 can be inserted into the cavity 142 or extracted from the cavity 142 through the top surface 146 of the container 140.

The interior surface 122 of the rigid member 110 can have a protrusion 120. In examples, the protrusion 120 can be sized to fit within an interior space of the cavity 142. The protrusion can also be sized with a height so that the protrusion leaves a clearance above the object 150 when the lid 102 is in a closed position and the object 150 is at rest at the bottom of the cavity 142. However, even in the closed condition, the protrusion 120 can restrict the movement of the object 150, as indicated by arrow 160.

In some embodiments, the cavity 142 can include an indentation or depression (not shown) sized smaller than the surface area of the object 150 such that when the object 150 is at rest at the bottom of the cavity 142 a portion of the surface area of the object 150 does not have contact with the bottom of the indentation. In some examples, the depression can protect the object 150 from damage, for example, being crushed while being inserted into or extracted from the cavity 142. In some embodiments, the cavity 142 can be sized and shaped to restrict movement of the object 150. For example, the cavity 142 can be sized and shaped to conform to the size and shape of the object 150. In this example, the object 150 can be restricted from rotating while resting at the bottom of the cavity 142, and can maintain its azimuthal orientation during transport to within an azimuthal tolerance. In examples, the azimuthal tolerance can be 1-5, 5-10, 10-30, or 30-90 degrees.

The protrusion 120 can also prevent the object 150 from being attracted and bonded to the interior surface 122 of the rigid member 110. Although only one protrusion 120 is shown, the rigid member 110 can have any number of protrusions 120.

The rigid member 110 can include a guide 130. When the lid 102 is used to close the container 140, the guide 130 can restrict the movement of the rigid member 110, as indicated schematically by arrow 162. The movement can be restricted to one degree of freedom, for example, parallel to the top surface of the container 140, in a sliding motion. In some implementations, the movement 162 can be restricted to a linear sliding movement. The movement 162 can cause the rigid member 110 to hide the cavity 142 (closed condition) or expose the cavity 142 (open condition).

Numerous extensions or variations of the illustrated lid can be implemented within the scope of the disclosed technologies, some of which are described in context of other examples or elsewhere herein. A protrusion 120 can be elongated so as to extend through multiple cavities 142. In other examples, the protrusion 120 can be sized to fit entirely within one cavity 142 when the lid is in a closed position. The container 140 can have corresponding grooves sized to accommodate the protrusion 120 with a width or clearance insufficient for the object 150 to escape from the cavity 142.

In some examples, sliding between the lid 102 and the container 140 can be a rotary motion about a pivot point. In further examples, the rigid member 110 or the container 140 can be provided with a groove for retaining a gasket, allowing the closed assembly of diagram 100 to be vacuum sealed. Stops can be provided on the lid 102 or on the container 140 to limit a range of sliding motion. A fitting or handle can be provided on the lid 102 to enable an actuator from effecting opening or closing of the lid 102. The interior surface 122 can be coated with an anti-static material. The lid 102 can include one or more apertures or transparent windows, for example, to allow for the reading of labels or codes (e.g., DataMatrix™ code or QR code™), while the container is in the closed condition. A single container 140 can have multiple lids 102 covering respective groups of cavities 142.

Second Example of Container Lid

FIG. 2A is a diagram 200 illustrating a second example of a container 250 and a lid 210. FIG. 2B is a diagram 202 illustrating a vertical sectional view of the container 250 and the lid 210 along plane AA' of FIG. 2A. For simplicity, only one cavity 260 is shown in FIG. 2B. In this example, the container 250 can have an elongated rectangular shape.

The container 250 includes one or more cavities (or pockets) 260. The cavities 260 are accessible through the top planar surface 256 of the container 250. Each cavity 260 can be sized to receive a lamella carrier 270, such that the lamella carrier 270 can lay flat on the bottom surface 253 of the cavity 260 and having a major surface 274 facing toward the lid 210. Although only two cavities 260 are shown in FIG. 2A, the container 250 can have any number of cavities. The lamella carrier 270 can be inserted into the cavity 260 or extracted from the cavity 260 through the top planar surface 256 of the container 250.

The lid 210 can include a rigid member 220. The rigid member 220 can have a planar shape portion having an exterior planar surface 221 and an interior planar surface 222 which is opposite the exterior surface 221. The interior surface face 222 is proximate and conforming to the top planar surface 256 of the container 250 when the lid 210 is attached to the container 250. However, there can be a gap 262 between the interior surface face 222 and the top surface 256.

The lid 210 can include means for constraining motion of planar surface 221 to sliding motion over top surface 256. In some examples, this motion constraint can be provided by wrap-around flanges 230, 232. The flanges 230, 232 can have an L-shaped cross-section with the portions 234, 236 extending inwardly toward a center axis CC', at least part way, under the bottom of the container 250. As such, the lid 210, with the flanges 230,232, can at least partially wrap around the container 250.

As the lid 210 can partially wrap around the container 250, the lid 210 can be constrained to only sliding movement 280 along the longitudinal length of the container 250. As such, the wrap-around flanges 230, 232 also inhibit movement of the lid in a direction outwardly normal, or away, from the top surface 256. As the lid 210 moves along the longitudinal length of the container 250, it can expose or cover the cavities 260. When no cavity 260 is exposed, the container is said to be in a closed condition. When one or more cavities 260 are exposed, the container is said to be in an open condition. In some examples, with the lid 210 in a first sliding position, N cavities 260 can be covered by the lid 210, and with the lid in a second sliding position, M cavities 260 can be covered by the lid 210, where M and N as non-negative integer numbers, with N>1 and M<N.

Multiple rows of cavities 260 can extend linearly along the length of container 250. For each linear row of cavities 260, the container 250 includes at least a corresponding groove 258 also arranged linearly along the length of container 250. Each groove 258 extends through one or more cavities 260. The cavities 260 and the grooves 258 can have a transverse extent, or depth, 255 extending from the top surface 256. As described herein, the container 250 can have any number of rows of cavities and corresponding grooves.

The lid 210 can also include means for restricting motion of an object 270 contained within the cavity 260. In some examples this means can be provided by protrusions 224, 226. In some embodiments, the protrusions 224, 226 can extend orthogonally from the interior planar surface 222. In other examples, the protrusions 224, 226 can extend non-orthogonally from the interior planar surface 222. The protrusions 224, 226 can be positioned so that they extend from the interior planar surface 222 into the cavities 260. The extension of the protrusions 224, 226 can be less than the depth 255, such that there can be a gap 259 between the tip of the protrusions 224, 226 and the bottom surface 253 of the cavity 260. Each protrusion 224, 226 can have an extension less than the depth 255, and can also extend into the grooves 258.

In this example, each of the protrusions 224, 226 can have the shape of an elongated ridge, extending linearly along the longitudinal length of the lid 210, container 250 and grooves 258. Each ridge 224, 226 extends into and along a corresponding groove 258, in the direction of the sliding movement 280 of the lid 210. In some embodiments, each ridge 224, 226 can have a length that allows the ridge to extend through all the cavities 260 positioned linearly along the corresponding groove 258. In some embodiments, the length of each ridge 224, 226 can be at least greater than an open top of a given cavity occupied by the ridge, or greater than half a length of the container in the direction of the sliding movement 280. Although FIGS. 2A and 2B depict two grooves 258 and two corresponding ridges 224, 226 passing through a cavity 260, the container 250 and lid 210 can have any number of grooves and corresponding ridges, e.g., 1, in a range 2-5, in a range 6-10, in a range 11-100, or even more.

The gap 259 between the tip of the ridges 224, 226 and the bottom surface 253 of the cavity 260 can constrain the lamella carrier 270 within a tolerance region proximate to the bottom of the cavity 260. The lamella carrier can only move within the gap 259, thus the lamella carrier can be prevented from reaching the gap 262 between the container top surface 256 and the lid 210. The tolerance region formed with the gap 259 can also prevent the lamella carrier 270 from flipping over or turning upside down from its initial or intended position. The ridges 224, 226 can also prevent the lamella carrier from making extensive contact with the interior planar surface 222 of rigid member 220. For example, the ridges 224, 226 can prevent the lamella carrier from attaching or sticking to the interior planar surface 222.

In some embodiments, the cavity 260 can include slanted side walls 252, 254 sloping upward, from the bottom of the cavity, and outwardly, from the center axis CC', as shown. The slanted walls 252, 254 and the flat bottom 253 can form a conical shape with a flat bottom. The outwardly slanted slope can allow the lamella carrier 270 to be extracted from the cavity 260 without contacting with the side walls 252, 254.

Although the narrow cross-section of the ridges 224, 226 substantially inhibits the lamella carrier 270 from adhering to the ridges 224, 226, it can be desirable in some applications to further protect against such a scenario. In some embodiments, the side walls 252, 254 can serve as a stop when the lid 210 and the ridges 224, 226 slide, carrying the lamella carrier 270 with them. Then, the lamella carrier 270 can be stopped by the side walls 252, 254 and can drop back down into the cavity 260 while the lid 210 and the ridges 224, 226 continue to slide.

Numerous extensions or variations of the illustrated lid can be implemented within the scope of the disclosed technologies, some of which are described elsewhere herein. In some examples, the flange portions 234, 236 can join across the bottom of the container 250. In varying examples, each cavity can accommodate a single protrusion 224, or more than two protrusions 224.

In some embodiments, the protrusions 224, 226 can have the shape of a stud. The studs 224, 226 can have a length less than, substantially equal to, or greater than the top length 267 of a given cavity occupied by the stud. The stud 224, 226 can fit entirely within a transverse extent of the respective cavity when the container is in the closed position. In some embodiments, aspect ratio of the transverse dimension can be about 1:1 (circular), less than 1.2:1, or less than 3:1. In some embodiments, the tip of a protrusion 224, 226 can have a rounded bottom end.

In some embodiments, the container 250 can include a lid movement constraining member. In the example of FIGS. 2A and 2B, the constraining member can include stop members 282, 284 situated at each end of the elongated container 250. The stop members 282, 284 can protrude from the top planar surface 256 of the container 250. The stop members 282, 284 can have an extension from the top planar surface 256 less than, substantially equal to, or larger than the thickness of the rigid member 220. The stop members 282, 284 can constrain the sliding movement 280 of the lid 210 to a finite extent.

Although FIG. 2A depicts two stop members 282, 284, the container 250 can have only one stop member. In other variations, container 250 or lid 210 can be provided with multiple detents to enable controlled opening of the container 250 in successive groups of cavities 260. In other variations, one or more stop members can be affixed to the lid 210, either in addition to or in lieu of being affixed to the container 250.

Third Example of Container Lid

Figure 3A:
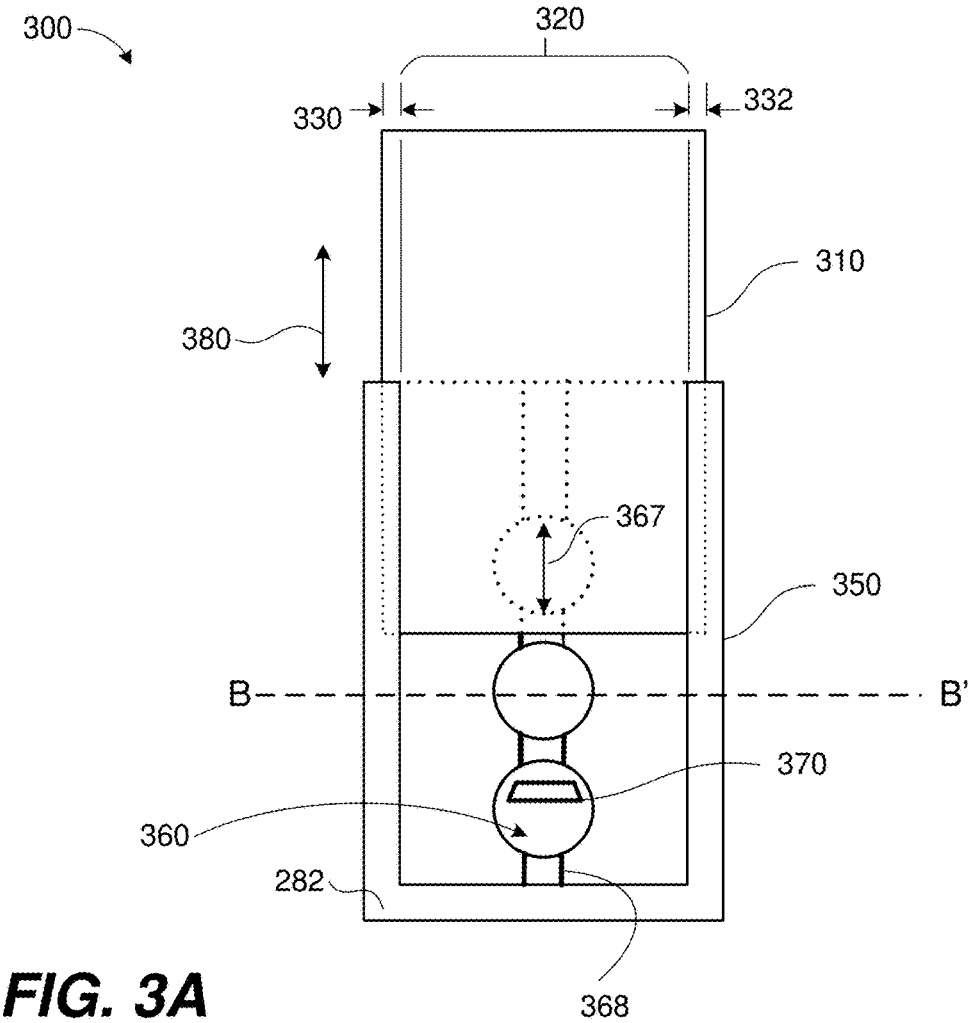
FIG. 3A illustrates a third example lid and container according to the disclosed technologies.
Figure 3B:
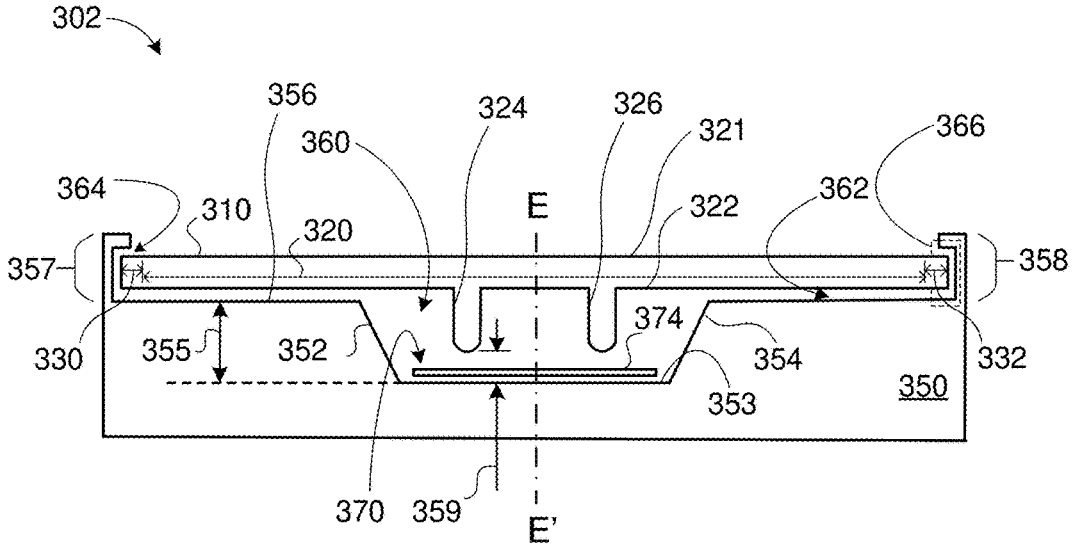
FIG. 3B illustrates a sectional view of the third example lid and container.

FIG. 3A is a diagram 300 illustrating a third example of a container 350 and a lid 310 partially open. FIG. 3B is a diagram 302 illustrating a vertical sectional view of the container 350 and the lid 310 along plane BB', with the lid 310 in a closed position. In this example, the container 350 can have an elongated rectangular shape.

The container 350 includes a plurality of cavities (or pockets) 360. The cavities 360 are accessible through the top planar surface 356 of the container 350. Each cavity 360 can be sized to receive a lamella carrier 370, such that the lamella carrier 370 can lay flat on the bottom surface 353 of the cavity 360 and can have a major surface 374 facing toward the lid 310. Although only three cavities 360 are shown in FIG. 3A, the container 350 can have any number of cavities. The lamella carrier 370 can be inserted into the cavity 360 or extracted from the cavity 360 through the top planar surface 356 of the container 350.

The lid 310 can include a rigid member 320. The rigid member 320 can have a planar shape portion having an exterior planar surface 321 and an interior planar surface 322 which is opposite the exterior surface 321. The interior surface face 322 is proximate and conforming to the top planar surface 356 of the container 350 when the lid 310 is attached to the container 350. However, there can be a gap 362 between the interior surface face 322 and the top surface 356.

The container 350 can include grooves 364, 366. The grooves 364, 366 extend along the longitudinal length of the container 350, and are sized to receive, or engage the flanges 330, 332 of the rigid member 320. As such, the grooves 364, 366 can have an extension substantially equal to or larger than the thickness of the rigid member 320. The flanges 330, 332 extend along each longitudinal side of the rigid member 320. In some embodiments, the grooves 364, 366 can be formed from extensions 357, 358 extending upward from the top planar surface 356 along the longitudinal sides of the container 350.

As the grooves 364, 366 engage the rigid member 320, the lid 310 can be constrained to only sliding movement along the longitudinal length of the container 350, as indicated by arrow 380. As such, the grooves 364, 366 also inhibit movement of the lid 310 in a direction outwardly normal, or away, from the top surface 356. As the lid 310 moves along the length of the container 350, it can expose or cover the cavities 360. When no cavity 360 is exposed, the container is said to be in a closed condition. When one or more cavities 360 are exposed, the container is said to be in an open condition. In some examples, with the lid 310 in a first sliding position, N cavities 360 can be covered by the lid 310, and with the lid in a second sliding position, M cavities 360 can be covered by the lid 310, where M and N as non-negative integer numbers, with N>1 and M<N.

In the example of FIGS. 3A and 3B, the cavities 360 are positioned linearly along the longitudinal length of container 350. For each linear row of cavities 360, the container 350 includes at least a corresponding groove 368 also positioned linearly along the longitudinal length of container 350. Each groove 368 extends through one or more cavities 360. The cavities 360 and the grooves 368 can have a transverse extent, or depth, 355 extending from the top surface 356. As described herein, the container 350 can have any number of rows of cavities and corresponding grooves.

The lid 310 can include protrusions 324, 326. In some embodiments, the protrusions 324, 326 can extend orthogonally from the interior planar surface 322. In other examples, the protrusions 324, 326 can extend non-orthogonally from the interior planar surface 322. The protrusions 324, 326 are positioned so that they extend from the interior planar surface 322 into the cavities 360. The extension of the protrusions 324, 326 can be less than the depth 355, such that there can be a gap 359 between the tip of the protrusions 324, 326 and the bottom surface 353 of the cavity 360. As each protrusion 324, 326 can have an extension less than the depth 355, the protrusion 324, 326 can also extend into the grooves 368.

In this example, each of the protrusions 324, 326 can have the shape of an elongated ridge, extending linearly along the longitudinal length of the lid 310, container 350 and grooves 368. Each ridge 324, 326 extends into and along a corresponding groove 368, and along the sliding movement 380 of the lid 310. In some embodiments, each ridge 324, 326 can have a length that allows the ridge to extend through all the cavities 360 positioned linearly along the corresponding groove 368. In some embodiments, the length of each ridge 324, 326 can be at least greater than an open top of a given cavity 360 occupied by the ridge 324, 326, or greater than half a length of the container 350 in the direction of the sliding movement 380. Although FIGS. 3A and 3B depict two grooves 368 and two corresponding ridges 324, 326, the container 350 and lid 310 can have any number of grooves and corresponding ridges.

The gap 359 between the tip of the ridges 324, 326 and the bottom surface 353 of the cavity 360 can constrain the lamella carrier 370 within a tolerance to the bottom of the cavity. The lamella carrier can only move within this gap, thus the lamella carrier can be prevented from reaching the gap 362 between the container top surface 356 and the lid 310. The ridges 324, 326 can also prevent the lamella carrier from making extensive contact with the interior planar surface 322 of rigid member 320. For example, the ridges 324, 326 can prevent the lamella carrier from attaching or sticking to the interior planar surface 322.

In some embodiments, the cavity 360 can include slanted side walls 352, 354 sloping upward, from the bottom of the cavity, and outwardly, from the center axis EE', as shown. The outwardly slanted slope can allow the lamella carrier 370 to be extracted from the cavity 360 without contacting with the side walls 352, 354.

Although the narrow cross-section of the ridges 324, 326 substantially inhibits the lamella carrier 370 from adhering to the ridges 324, 326, it can be desirable in some applications to further protect against such a scenario. In some embodiments, in case the lamella carrier 370 attaches to the tip of the ridges 324, 326, the side walls 352, 354 can serve as a stop when the lid 310 and the ridges 324, 326 slide, carrying the lamella carrier 370 with them. Then, the lamella carrier 370 can be stopped by the side walls 352, 354 and can drop back down into the cavity 360 while the lid 310 and the ridges 324, 326 continue to slide.

In some embodiments, the protrusions 324, 326 can have the shape of a stud. The studs 324, 326 can have a length less than, substantially equal to, or greater than the open top width 367 of a given cavity occupied by the stud. The stud 324, 326 can fit entirely within a transverse extent of the respective cavity when the container is in the closed position. In some embodiments, aspect ratio of transverse dimension can be about 1:1 (circular), less than 1.2:1, or less than 3:1.

In some embodiments, the tips of the protrusions 324, 326 can have rounded convex (as shown) or concave shapes. The tip of the protrusion 324, 326 can also have or include other shapes. Any of these profiles can reduce the surface area of the protrusion that can come into contact with the lamella carrier 270 or with another object.

In some embodiments, the container 350 can include a lid movement constraining member. In the example of FIGS. 3A and 3B, the constraining member can include stop member 382 situated at one end of the elongated container 350. The stop member 382 can protrude from the top planar surface 356 of the container 350, connecting the two grooves 364, 366. The stop member 382 includes a groove (not shown) sized similar to the grooves 364, 366, to receive, or engage the short end of the rigid member 320. The stop member 382 can stop the sliding movement 380 of the lid 310 in a closed condition of the container 350. In other variations, one or more stop members can be affixed to the lid 310, either in addition to or in lieu of being affixed to the container 350.

Numerous extensions or variations of the illustrated lid can be implemented within the scope of the disclosed technologies, some of which are described elsewhere herein. FIG. 3A depicts a single column of cavities 360 extending longitudinally in the sliding direction 380. In variations, the cavities 360 can be arranged as a single row extending parallel to section line BB', or in multiple rows or columns. Lid 310 can include a window, so that only one or a few cavities are open at a time.

Fourth Example of Container Lid

Figure 4A:
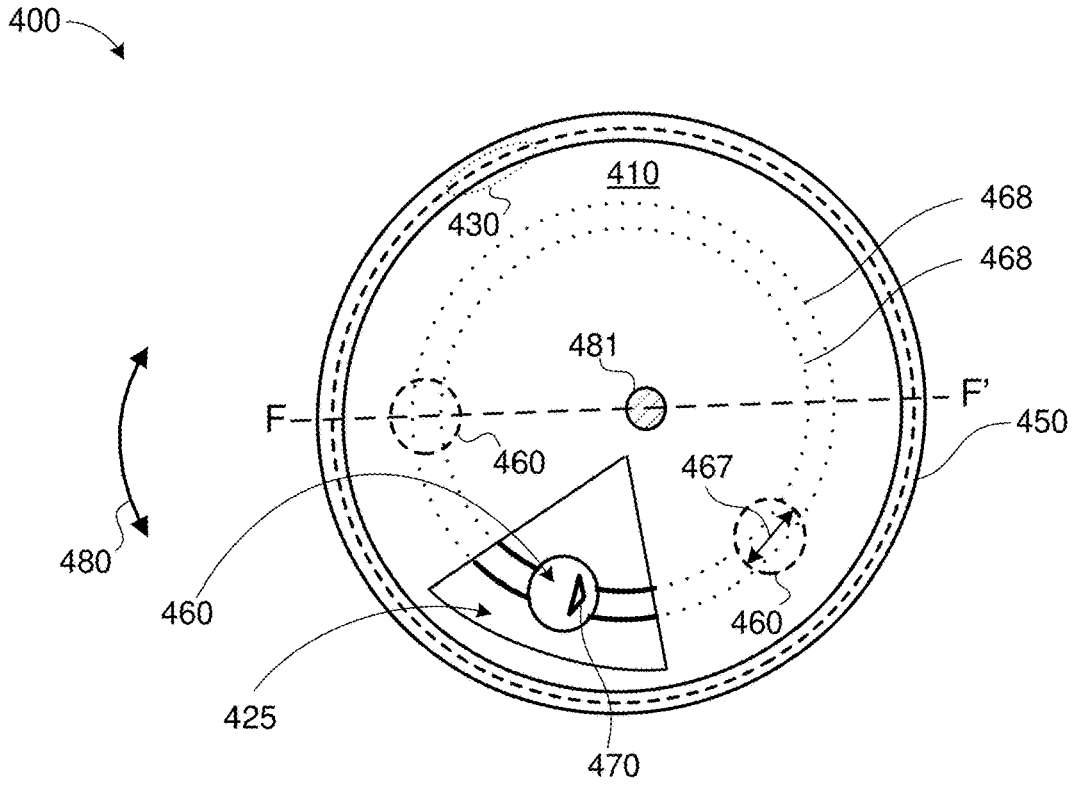
FIG. 4A illustrates a fourth example lid and container according to the disclosed technologies.
Figure 4B:
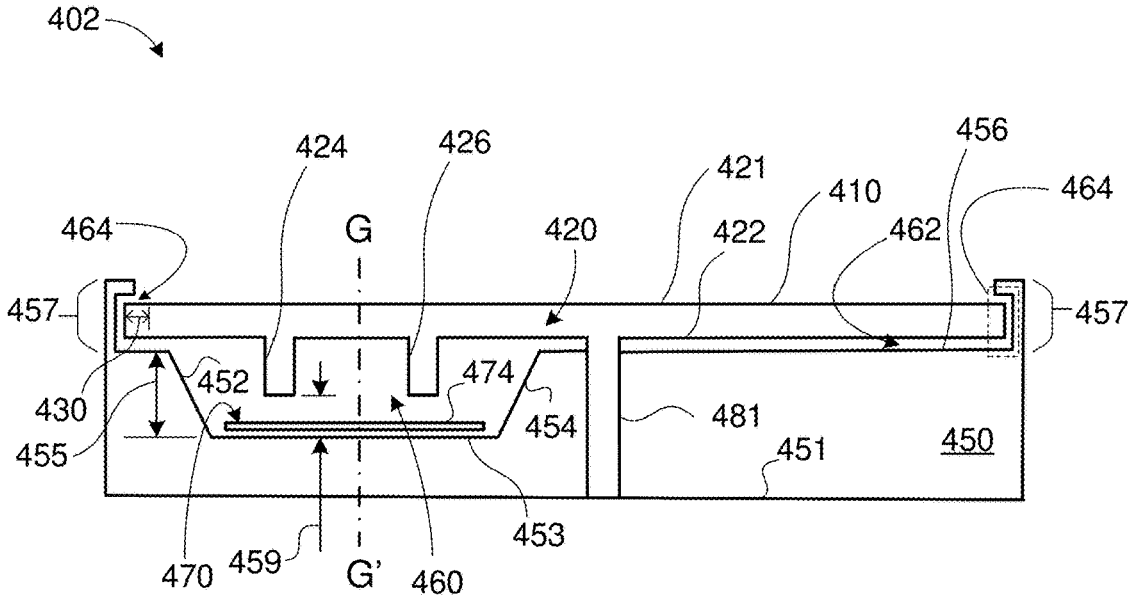
FIG. 4B illustrates a sectional view of the fourth example lid and container.

FIG. 4A is a diagram 400 illustrating a fourth example of a container 450 and a lid 410. FIG. 4B is a diagram 402 illustrating a vertical sectional view of the container 450 and the lid 410 along plane FF'. In this example, the container 450 can have circular shape.

The container 450 includes a plurality of cavities (or pockets) 460. The cavities 460 are accessible through the top planar surface 456 of the container 450. Each cavity 460 can be sized to receive a lamella carrier 470, such that the lamella carrier 470 can lay flat on the bottom surface 453 of the cavity 460 and having a major surface 474 facing toward the circular lid 410. Although only three cavities 460 are shown in FIG. 4A, the container 450 can have any number of cavities. The lamella carrier 470 can be inserted into the cavity 460 or extracted from the cavity 460 through the top planar surface 456 of the container 450.

The lid 410 can include a rigid member 420. The rigid member 420 can have a planar shape portion having an exterior planar surface 421 and an interior planar surface 422 which is opposite the exterior surface 421. The interior surface face 422 is proximate and conforming to the top planar surface 456 of the container 450 when the lid 410 is attached to the container 450. However, there can be a gap 462 between the interior surface face 422 and the top surface 456.

In some embodiments, the rigid member 420 can include an aperture 425. The aperture 425 can have an open area larger than the open area of at least one cavity 460.

The container 450 can include groove 464. The groove 464 can extend around the perimeter of the container 450, and sized to receive, or engage the flange 430 of the rigid member 420. As such, the groove 464 can have an extension larger than the thickness of the rigid member 420. The flange 430 can extend continuously or piecewise around the perimeter of the rigid member 420. In an example, the flange 430 can include several distinct tabs placed around the perimeter of the rigid member 420. In some embodiments, the groove 464 can be formed from extension 457 extending upward from the top planar surface 456 around the perimeter of the container 450.

As the groove 464 engages the rigid member 420, the lid 410 can be constrained to an azimuthal rotation 480 about the pivot point 481. As such, the groove 464 also inhibits the lid in a direction outwardly normal, or away, from the top surface 456. In some embodiments, the pivot point 481 can include a post extending from the interior surface face 422 of the rigid member 422 to the bottom surface 451 of the container 450. In some embodiments, an aperture on the bottom surface 451 of the container and a correspondingly aligned aperture in the interior surface face 422 can be positioned to engage, at the pivot point 481, with the post. In some implementations, the post can be fixedly attached to either the bottom surface 451 of the container or the interior surface 422 of the rigid member 420, and the aperture can be in the other unit. The post and the corresponding aperture can extend through or part-way into the bottom surface 451 of the container or the interior surface 422 of the rigid member 420.

As the lid 410 rotates around the pivot point 481, it can selectively expose or cover one or more of the cavities 460. A given cavity 460 can be exposed when the aperture 425 is aligned with the given cavity 460. When no cavity 460 is exposed, the container is said to be in a closed condition. When one or more cavities 460 are exposed, the container is said to be in an open condition. In some examples, with the lid 410 in a first sliding position, N cavities 460 can be covered by the lid 410, and with the lid in a second sliding position, M cavities 460 can be covered by the lid 410, where M and N as non-negative integer numbers, with N>1 and M<N.

In the example of FIG. 4A, the cavities 460 are positioned concentric with the circumference of the container 450. For each row of cavities 460, the container 450 can include one or more corresponding groove 468 also positioned concentric with the circumference of the container 450. Each groove 468 can extend through one or more cavities 460. The cavities 460 can have a depth 455 extending from the top surface 456. In varying embodiments, grooves 468 can have depth less than or equal to cavity depth 455. In variations, the container 450 can have any number of circular rings of cavities and corresponding grooves. The aperture 425 can simultaneously expose multiple cavities 460 on respective rings.

The lid 410 can include protrusions 424, 426. In some embodiments, the protrusions 424, 426 can extend orthogonally from the interior planar surface 422. In other examples, the protrusions 424, 426 can extend non-orthogonally from the interior planar surface 422. The protrusions 424, 426 can be positioned so that they can extend from the interior planar surface 422 into the cavities 460. The downward extension of the protrusions 424, 426 can be less than the depth of grooves 468 and also less than cavity depth 455, such that there can be a gap 459 between the tip of the protrusions 424, 426 and the bottom surface 453 of the cavity 460.

In this example, each of the protrusions 424, 426 can have the shape of an incomplete circular ridge, extending azimuthally about pivot point 481, concentric with the grooves 468, the lid 410, and the groove 464. The circle of the ridge 424, 426 is incomplete as it is broken at the aperture 425. Each ridge 424, 426 can extend into a corresponding groove 468. In some embodiments, each ridge 424, 426 can have a length that allows the ridge to extend through all the cavities 460 distributed azimuthally along the corresponding groove 368 when the container 450 is in the closed condition. In some embodiments, the length of each ridge 424, 426 can be at least greater than an open top length 467 of a given cavity 460 in the azimuthal direction, or greater than 90° or 180° in the azimuthal direction. Although FIGS. 4A and 4B depict two grooves 468 and two corresponding ridges 424, 426, the container 450 and lid 410 can have any number of grooves and corresponding ridges.

The gap 459 between the tip of the ridges 424, 426 and the bottom surface 453 of the cavity 460 can constrain the lamella carrier 470 within a tolerance to the bottom of the cavity. The lamella carrier can only move within this gap, thus the lamella carrier can be prevented from reaching the gap 462 between the container top surface 456 and the lid 410. The ridges 424, 426 can also prevent the lamella carrier from making extensive contact with the interior planar surface 422 of rigid member 420. For example, the ridges 424, 426 can prevent the lamella carrier from attaching or sticking to the interior planar surface 422.

In some embodiments, the cavity 460 can include slanted side walls 452, 454 sloping upward, from the bottom surface 453 of the cavity, and outwardly, from the center axis GG' of the cavity 460, as shown. The outwardly slanted slope can allow the lamella carrier 470 to be extracted from the cavity 460 without contacting with the side walls 452, 454.

Although the narrow cross-section of the ridges 424, 426 substantially inhibits the lamella carrier 470 from adhering to the ridges 424, 426, it can be desirable in some applications to further protect against such a scenario. In some embodiments, the side walls 452, 454 can serve as a stop when the lid 410 and the ridges 424, 426 slide, carrying the lamella carrier 470 with them. Then, the lamella carrier 470 can be stopped by the side walls 452, 454 and can drop back down into the cavity 460 while the lid 410 and the ridges 424, 426 continue to slide.

In some embodiments, the protrusions 424, 426 can have the shape of a stud. The studs 424, 426 can have a length less than, substantially equal to, or greater than the open top width 467 of a given cavity occupied by the stud. The stud 424, 426 can fit entirely within a transverse extent of the respective cavity when the container is in the closed position. In some embodiments, aspect ratio of transverse dimension can be about 1:1 (circular), less than 1.2:1, or less than 3:1.

In some embodiments, a tip of a protrusion 424, 426 can have a rounded convex or concave shape. The tip of the protrusion 424, 426 can also have or include other shapes.

Although FIGS. 4A and 4B depict the pivot point 481 positioned at the center of the container 450 and lid 410, the pivot point 481 can also be positioned at another location in the container 450.

Numerous extensions or variations of the illustrated lid can be implemented within the scope of the disclosed technologies, some of which are described elsewhere herein. FIG. 4A depicts a lid 410 having a single aperture 425 exposing a single cavity 460. In variations, aperture 425 can expose multiple cavities 460, or lid 410 can incorporate multiple distinct apertures 425. In other variations, the container 450 or the lid 410, or both, can include a lid movement constraining member.

Example System

Figure 5:
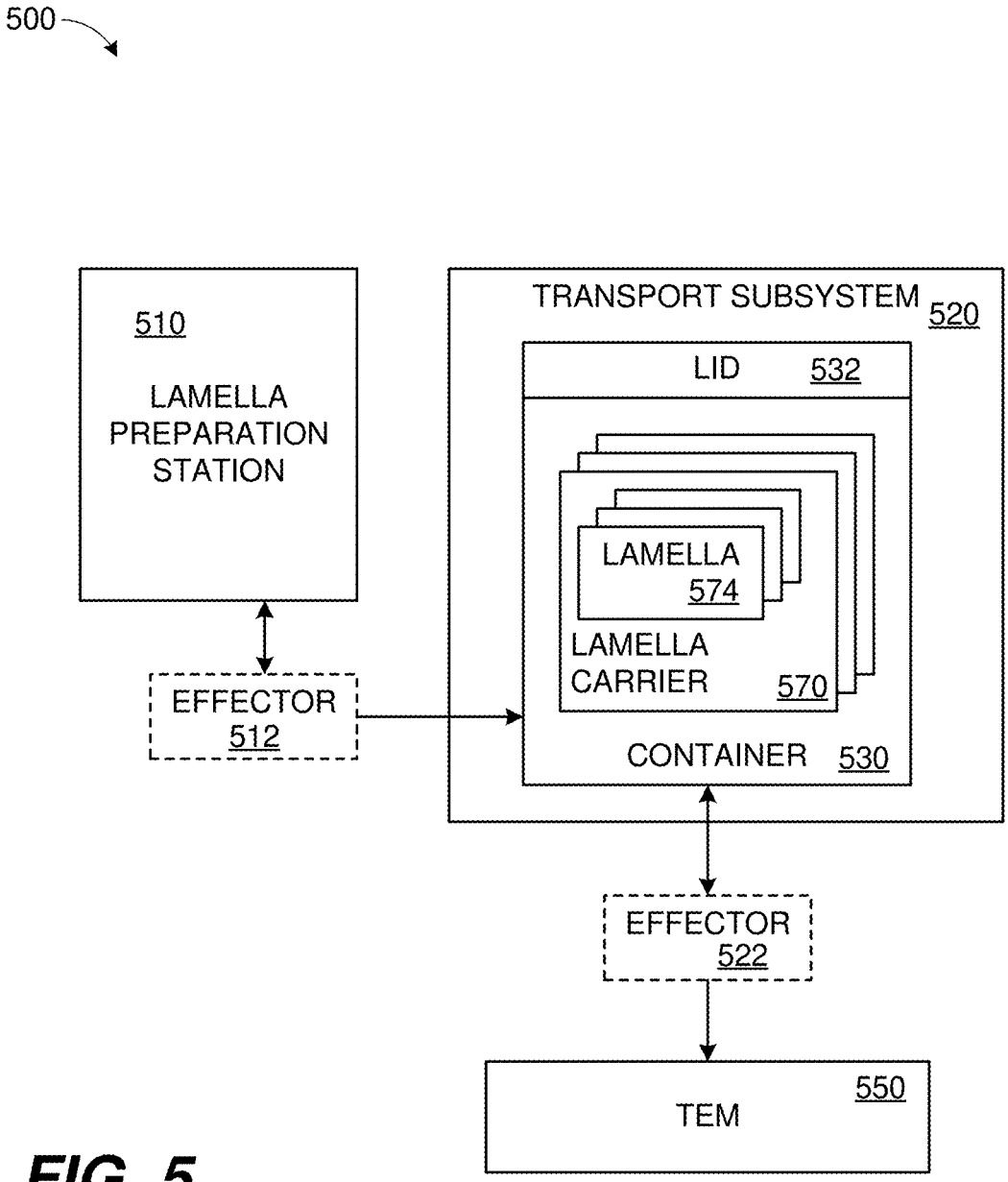
FIG. 5 is a diagram illustrating an example system incorporating the disclosed technologies.

In some examples, the disclosed technologies can be applied to automated handling of lamella carriers. FIG. 5 is a diagram 500 illustrating an operational system, located, for example on a lab or production floor, that can include a lamella preparation station 510, a transport subsystem 520 and a transmission electron microscope (TEM) 530. In some embodiments, the lamella preparation station 510, can include a vacuum chamber with load lock. In some examples, once lamellae 574 have been attached to lamella carriers 570, an effector 512 can deposit (or insert) lamella carriers 570 into lamella carrier container 530. The effector 512 can be a vacuum pipette or another type of end effector. In some examples, the lamella carrier container 530 or the lid 532 can be according to an example embodiment described herein, but this is not a requirement and, in other examples, other designs of the container 530 or the lid 532 can be used.

In some embodiments, the effector 512 can deposit each lamella carrier 570 into a respective cavity in the lamella carrier container 530. After the lamella carriers 570 have been deposited into the cavities, the effector 512 or another actuator (not shown) can close the lid 532. For example, the effector 512 can cause the lid 532 to slide into a position to cover all cavities. In some embodiments, the effector 512 or another actuator can also secure the lid 532 to the lamella carrier container 530.

The container 530 can then be transported through a transportation subsystem 520. In some examples, the transportation subsystem 520 can include a conveyor belt. The transportation subsystem 520 can transport the lamella carrier container 530 to the TEM 530. The TEM 530 can include, for example, a vacuum chamber with a load lock through which lamella carriers 570 can be introduced into a sample chamber of the TEM. Like the effector 512, the effector 522 can be a vacuum pipette or another type of end effector. In some embodiments, the effector 522 or another actuator can open the lid 532 prior to extraction of a lamella carrier 570. For example, the effector 522 can cause the lid 532 to slide into a position to expose one or more cavities of the lamella carrier container 530. The lamella carriers 570 can then be extracted from the exposed cavities.

Numerous extensions or variations of the illustrated lid can be implemented within the scope of the disclosed technologies, some of which are described elsewhere herein. For example, transportation subsystem 520 can include a robotic arm or a pneumatic tube. In some embodiments, the transportation subsystem 520 can include or can be used with a Front Opening Universal Pod (FOUP). Effector 512 can be configured to extract a lamella carrier 570 from the lamella preparation station 510 and insert the lamella carrier into the container 530. Effector 522 can be configured to extract the lamella carrier from the container 530 and insert the lamella carrier 570 into a load lock of the TEM 550. A spring-loaded lid or a magnetic lid can also be used. An external actuator can slide the lid 532 open (for example, by causing a spring to compress or expand further). The lid 532 can then be closed automatically by removing the actuator to revert the lid to its nominal position.

Example Method

Figure 6:
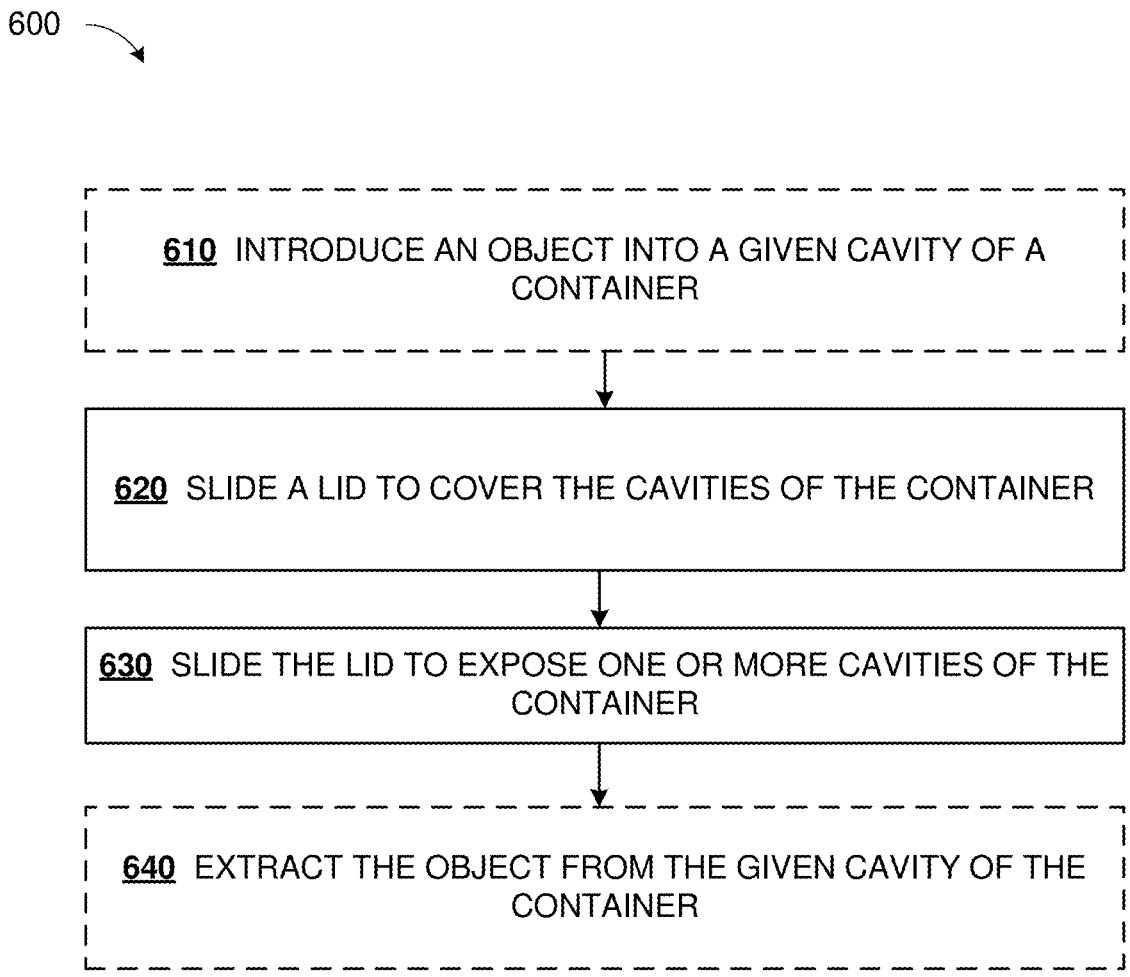
FIG. 6 is a flowchart of an example method according to the disclosed technologies.

FIG. 6 is a flowchart 600 of a first example method for automated handling of lamella carriers. The flowchart 600 can include process blocks for operating a container and lid as disclosed herein. In variations, the method can be extended to include packaging lamellae or lamella carriers in a lamella carrier container, transporting the lamella carrier container, and extracting the lamellae or lamella carriers from the lamella carrier container.

At process block 620, the lid of the container can be slid to cover one or more cavities of the container prior to transporting the container. The lid can be constrained to slide in a first direction over a top surface of a container. This can put the container in a closed condition with all cavities, or all occupied cavities, covered. In some embodiments, the sliding movement of the lid at block 620 can be restricted by a stop.

At process block 630, after transporting the container, the lid of the container can be slid to expose one or more cavities of the container. In some examples, the lid can be slid in a second direction over the top surface of the container. This can put the container in an open, or partially open, condition, with at least one cavity exposed. In some embodiments, the sliding movement of the lid at block 630 can be restricted by another stop.

Numerous variations and extensions of the disclosed method can be implemented. In some embodiments, process block 620 can be preceded by optional process block 610, shown in dashed outline. At process block 610, an object can be introduced into a cavity of a container. For example, a lamella carrier can be deposited into a cavity of an example lamella carrier container described above. Multiple lamella carriers can be loaded into respective cavities of the lamella carrier container. In further embodiments, block 630 can be followed by optional process block 640, the object can be extracted from its cavity. Multiple lamella carriers can be extracted from respective cavities of the lamella carrier container. In another example variation, process block 610 can be preceded with sliding the lid to expose one or more cavities. In another variation, process block 640 can be followed with sliding the lid to cover the cavities. In some other variations, the container can remain in the closed condition until the objects need to be extracted from the cavities. This can protect the objects and prevent contamination.

ADDITIONAL EXAMPLES

The following are additional examples of the disclosed technologies.

Example 1 is a lid for one or more cavities, including a first cavity, accessible through a top surface of a container, comprising: a rigid member having a planar surface and, affixed to the rigid member: first means for constraining motion of the planar surface to sliding over the top surface; and second means for restricting motion, within the first cavity, of an object contained within the cavity.

Example 2 includes the subject matter of Example 1, and further specifies that the object is restricted, by the second means, from reaching a gap between the top surface of the container and the planar surface of the rigid member, or from flipping over from its initial or intended position.

Example 3 includes the subject matter of any of Examples 1-2, and further specifies that a major surface of the object is restricted, by the second means, from making extensive contact with the planar surface of the rigid member.

Example 4 includes the subject matter of any of Examples 1-3, and further specifies that the motion of the planar surface is constrained by the first means to linear translation relative to the container.

Example 5 includes the subject matter of Example 4, and further specifies that the first means comprises one or more wrap-around flanges positioned to extend at least part way around the container.

Example 6 includes the subject matter of any of Examples 1-5, and further specifies that the motion of the planar surface is constrained by the first means to azimuthal rotation about a pivot point.

Example 7 includes the subject matter of Example 6, and further specifies that the first means comprises a post positioned to engage, at the pivot point, with an aperture on the container or an aperture on the planar surface, at the pivot point.

Example 8 includes the subject matter of any of Examples 1-7, and further specifies that the first means comprises one or more flanges positioned to engage with one or more grooves of the container extending in a direction of the sliding.

Example 9 includes the subject matter of any of Examples 1-8, and further specifies that the first means inhibits motion of the planar surface in a direction outwardly normal from the top surface of the container.

Example 10 includes the subject matter of any of Examples 1-9, and further specifies that N>1 and M<N are non-negative integer numbers of the one or more cavities, wherein with the lid in a first sliding position, N cavities are covered by the lid, and wherein, with the lid in a second sliding position M cavities are covered by the lid.

Example 11 includes the subject matter of any of Examples 1-10, and further specifies that N is 1, 2, in a range 3 to 10 inclusive, in a range 11 to 100 inclusive, in a range 101 to 10,000 inclusive, or in a range 10,001 to 1,000,000 inclusive.

Example 12 includes the subject matter of any of Examples 1-11, and further specifies that the sliding is limited to a finite extent by one or more stops affixed to the container or to the lid.

Example 13 includes the subject matter of any of Examples 1-12, and further specifies that the second means comprises one or more protrusion.

Example 14 includes the subject matter of Example 13, and further specifies that each of the one or more protrusions is a ridge (i) having a longitudinal extent in a direction of the sliding, and (ii) positioned, with the lid in a first sliding position, to occupy at least one of the one or more cavities.

Example 15 includes the subject matter of Example 14, and further specifies that the longitudinal extent of the ridge is: greater than an extent of a given cavity occupied by the ridge; greater than half a length of the container in the direction of the sliding; or within 10% of the extent of the given cavity occupied by the ridge.

Example 16 includes the subject matter of Example 13, and further specifies that each of the one or more protrusions is a stud extending from the lid into a respective cavity of the one or more cavities.

Example 17 includes the subject matter of any of Examples 16, and further specifies that, with the lid in a first sliding position, the stud is situated entirely within a transverse extent of the respective cavity.

Example 18 includes the subject matter of any of Examples 1-17, and further specifies that the rigid member is a plate.

Example 19 includes the subject matter of any of Examples 1-18, and further specifies that the rigid member is, at least partly, optically translucent or optically transparent.

Example 20 includes the subject matter of any of Examples 1-19, and further specifies that each cavity of the one or more cavities is sized to contain a lamella carrier, wherein a transverse extent of the each cavity is greater than a corresponding transverse extent of the lamella carrier by at most a tolerance, wherein the tolerance is an a range 1% to 100% of the corresponding extent of the lamella carrier.

Example 21 is a lid for a container, including: a rigid member slidably retained over a surface of the container; one or more guides affixed to the rigid member and engaged with the container, wherein the one or more guides limit relative motion of the lid and the container to one sliding direction; and one or more protrusions affixed to the rigid member and extending into respective cavities within the container.

Example 22 includes the subject matter of Example 21, and further specifies that the container is a lamella carrier container.

Example 23 includes the subject matter of any of Examples 21-22, and further specifies that the surface is a first surface and the rigid member comprises a second surface proximate and conforming to the first surface, wherein each protrusion of the one or more protrusions blocks an object, in the respective cavity of the each protrusion, from (i) making extensive contact with second surface, (ii) entering a gap between the first surface and the second surface, or (iii) from flipping over from its initial or intended position.

Example 24 is a container assembly comprising the lid of Example 21 and the container.

Example 25 includes the subject matter of Example 24, and further specifies that a given cavity of the cavities is shaped to restrict azimuthal rotation of an object situated within the given cavity, the object has a shape of a segment of a circle, a bottom surface of the given cavity is formed with a depression to reduce a surface area of the given cavity in contact with the object, or the protrusions have bottom edges shaped to reduce a surface area of the protrusions which can come into contact with the object.

Example 26 is a system comprising: a lamella preparation station; a conveyor supporting the container assembly of Example 25 and coupled to the lamella preparation station to receive one or more lamellas from the lamella preparation station; and a transmission electron microscope (TEM) coupled to the lamella preparation station to receive the one or more lamellas from the conveyor.

Example 27 includes the subject matter of Example 26, and further includes: a first end effector configured to insert one or more lamella carriers, supporting the one or more lamellas, into the container assembly at the lamella preparation station; and a second end effector configured to extract the one or more lamella carriers from the container assembly at the TEM.

Example 28 is a method, including: prior to transport of a container, sliding a lid to cover one or more cavities accessible from a top surface of the container, wherein the lid is constrained to slide in one direction over the top surface; and subsequent to the transport, retracting the lid to expose the one or more cavities; wherein a protrusion from the lid into a given cavity of the one or more cavities prevents, during the transport, an object stored within the given cavity from (i) sticking to the lid, (ii) entering a gap between the top surface and the lid, or (iii) or from flipping over from its initial or intended position.

Example 29 includes the subject matter of Example 28, and further specifies that the object is a lamella carrier.

Example 30 includes the subject matter of any of Examples 28-29, comprising, prior to the sliding, introducing the object into the given cavity.

Example 31 includes the subject matter of any of Examples 28-30, comprising, subsequent to the retracting, extracting the object from the given cavity.

In some embodiments, the rigid member of the various examples of the lids can be, at least partly, optically translucent or optically transparent. The rigid member of the various examples of the lids can be a plate, or a three-dimensional component with a flat bottom surface. In some embodiments, the rigid member of the various examples of the lids can include one or more handles, or the like.

General Considerations

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items. Furthermore, as used herein, the terms "or" and "and/or" mean any one item or combination of items in the phrase.

The systems, methods, and apparatus described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. The technologies from any example can be combined with the technologies described in any one or more of the other examples. Any theories of operation are to facilitate explanation, but the disclosed systems, methods, and apparatus are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or apparatus may be referred to as "lowest", "best", "maximum," "optimum," "extremum," or the like. It will be appreciated that such descriptions are intended to indicate that a selection among a few or among many alternatives can be made, and such selections need not be lower, better, less, or otherwise preferable to other alternatives not considered. In particular, while the examples disclosed above generally adjust beam focus, working distance, or other parameters based on or at one or more extrema in measured current, this is not a requirement.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods that function in the manner described by such theories of operation.

In view of the many possible embodiments to which the principles of the disclosed subject matter may be applied, it should be recognized that the illustrated embodiments are only preferred examples of the disclosed subject matter and should not be taken as limiting the scope of the claims. Rather, the scope of the claimed subject matter is defined by the following claims. We therefore claim all that comes within the scope and spirit of these claims.

We claim:

1. A lid for one or more cavities, the one or more cavities accessible through a top surface of a container for transporting electron microscope samples, the lid comprising:

a rigid member having a planar surface;

one or more protrusions extending from the planar surface into a corresponding cavity when the lid is in a closed position, the one or more protrusions being dimensioned relative to the cavity to define a clearance with an object disposed within the cavity and configured to restrict motion of the object by direct mechanical engagement with the object; and one or more surfaces configured to abut one or more portions of the container to constrain motion of the planar surface to sliding over the top surface.

2. The lid of claim 1, wherein the object is restricted, by the one or more protrusions, from reaching a gap between the top surface of the container and the planar surface of the rigid member, or from flipping over from an initial or intended position.

3. The lid of claim 1, wherein a major surface of the object is restricted, by the one or more protrusions, from making extensive contact with the planar surface of the rigid member.

4. The lid of claim 1, wherein the motion of the planar surface is constrained by the abutting of the one or more surfaces with the one or more portions of the container to linear translation relative to the container.

5. The lid of claim 1, wherein the one or more surfaces are included in flanges of the lid, and wherein the flanges comprise portions extending under a bottom of the container.

6. The lid of claim 1, wherein the one or more protrusions extend orthogonally into the one or more cavities from the planar surface.

7. The lid of claim 1, wherein the the one or more surfaces inhibits motion of the planar surface in a direction outwardly normal from the top surface of the container.

8. The lid of claim 1, wherein $N > 1$ and $M < N$ are non-negative integer numbers of the one or more cavities, wherein with the lid in a first sliding position, N cavities are covered by the lid, and wherein, with the lid in a second sliding position M cavities are covered by the lid.

9. The lid of claim 1, wherein the one or more protrusions extend non-orthogonally into the one or more cavities from the planar surface.

10. The lid of claim 1, wherein each of the one or more protrusions is a ridge (i) having a longitudinal extent in a direction of the sliding, and (ii) positioned, with the lid in a first sliding position, to occupy at least one of the one or more cavities.

11. The lid of claim 10, wherein the longitudinal extent of the ridge is greater than an extent of a given cavity occupied by the ridge.

12. The lid of claim 1, wherein each of the one or more protrusions is a stud extending from the lid into a respective cavity of the one or more cavities.

13. The lid of claim 1, wherein the rigid member is a plate.

14. The lid of claim 1, wherein each cavity of the one or more cavities is sized to contain a lamella carrier, wherein a transverse extent of each cavity is greater than a corresponding transverse extent of the lamella carrier by the clearance, wherein the clearance is in a range of 1% to 100% of the corresponding extent of the lamella carrier.

15. A lid for a container, comprising:

a rigid member slidably retained over a surface of the container;

one or more flanges affixed to the rigid member and engaged with the container, wherein the one or more flanges restrict relative motion of the lid and the container to one sliding direction;

and one or more protrusions affixed to the rigid member and extending, when the lid is in a closed position, from the rigid member into respective cavities within the container, the one or more protrusions dimensioned relative to the cavity to define a clearance with an object disposed within the cavity and configured to restrict motion of the object by direct mechanical engagement with the object.

16. The lid of claim 15, wherein the container is a lamella carrier container.

17. The lid of claim 15, wherein the surface is a first surface and the rigid member comprises a second surface proximate and conforming to the first surface, wherein each protrusion of the one or more protrusions blocks an object, in the respective cavity of each protrusion, from (i) making extensive contact with second surface, (ii) entering a gap between the first surface and the second surface, or (iii) from flipping over from an initial or intended position.

18. A container assembly comprising the lid of claim 15 and the container.

19. The container assembly of claim 18, wherein:

a given cavity of the cavities is shaped to restrict azimuthal rotation of an object situated within the given cavity;

the object has a shape of a segment of a circle;

a bottom surface of the given cavity is formed with a depression to reduce a surface area of the given cavity in contact with the object; or the protrusions have bottom edges shaped to reduce a surface area of the protrusions which can come into contact with the object.

20. A system comprising:

a lamella preparation station;

a conveyor supporting the container assembly of claim 18 and coupled to the lamella preparation station to receive one or more lamellas from the lamella preparation station; and a transmission electron microscope (TEM) coupled to the lamella preparation station to receive the one or more lamellas from the conveyor.

* * * * *